US006048114A

United States Patent [19]

de Troz

[11] Patent Number: 6,048,114

[45] **Date of Patent: *Apr. 11, 2000**

[54] METHOD OF PRINTING ON THE EDGE OF A BOOK

[76] Inventor: Vincent de Troz, 31 rue du Maka, B-1370, Jauchelette, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,856

[22] PCT Filed: Feb. 7, 1996

[86] PCT No.: PCT/IB96/00092

§ 371 Date: Aug. 8, 1997

§ 102(e) Date: Aug. 8, 1997

[87] PCT Pub. No.: WO96/24491

PCT Pub. Date: Aug. 15, 1996

[30] Foreign Application Priority Data

Feb. 9, 1995 [GB] United Kingdom ..... 9502525

[51] Int. Cl.[7] ..... B41J 3/28; B41J 3/407

[52] U.S. Cl. ..... 400/24; 400/27; 283/40; 283/38

[58] Field of Search ..... 400/24, 25, 27, 400/28; 101/476; 283/63.1, 38, 40, 42, 43

[56] References Cited

U.S. PATENT DOCUMENTS

| | | | |
|---|---|---|---|
| 1,866,968 | 7/1932 | Ellison | 283/40 |
| 2,369,173 | 2/1945 | Oppenheimer | 283/42 |
| 2,680,630 | 6/1954 | Machol | 283/38 |
| 3,817,492 | 6/1974 | Raymer | 283/63.1 |
| 4,300,791 | 11/1981 | Bohrer et al. | 283/38 |
| 4,427,290 | 1/1984 | Kaye et al. | 283/38 |
| 4,813,710 | 3/1989 | Weilgart | 283/40 |
| 4,823,150 | 4/1989 | Kage et al. | 283/42 |
| 4,949,999 | 8/1990 | Ke-hui | 283/38 |
| 5,016,191 | 5/1991 | Radochonski | 400/83 |
| 5,085,529 | 2/1992 | McGourty et al. | 400/76 |
| 5,127,677 | 7/1992 | Merry | 283/92 |
| 5,166,809 | 11/1992 | Surbrook | 358/456 |
| 5,409,318 | 4/1995 | Imamiya | 400/76 |
| 5,469,267 | 11/1995 | Wang | 358/298 |
| 5,624,138 | 4/1997 | Park | 283/36 |

FOREIGN PATENT DOCUMENTS

| | | |
|---|---|---|
| 2073051 | of 0000 | United Kingdom . |
| 82/03205 | of 0000 | WIPO . |

*Primary Examiner*—John S. Hilten
*Assistant Examiner*—Daniel J. Colilla
*Attorney, Agent, or Firm*—MacMillan, Sobanski & Todd, LLC

[57] ABSTRACT

A method of providing at least one indicia on the edges of a plurality of stacked leaves assembled one on top of the other to form a book or pamphlet, each respective leaf having marks thereon on at least one face of the leaf adjacent said edge, the assemblage of the marks on the individual leaves forming said indicia on the edge. The indicia or indicia are broken down into elements and each element is assigned Cartesian coordinates according to the X and Y coordinate system with the y-coordinates corresponding to the pagination of a respective leaf, and the x-coordinates for each respective leaf corresponding to individual mark elements on the face of the leaf.

25 Claims, 4 Drawing Sheets

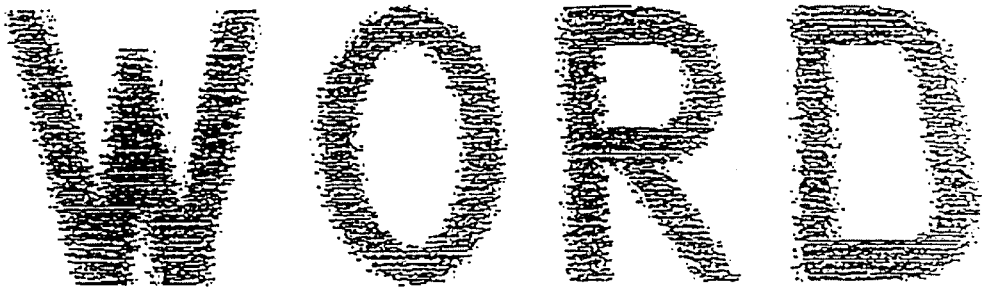
FIG. 9
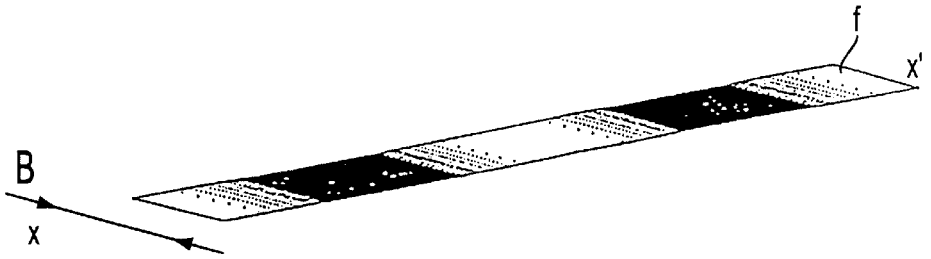
FIG. 10
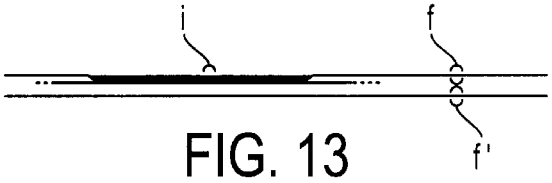
FIG. 13
FIG. 11
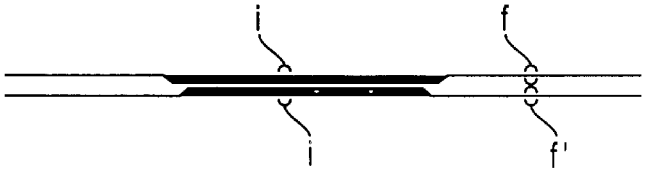
FIG. 12
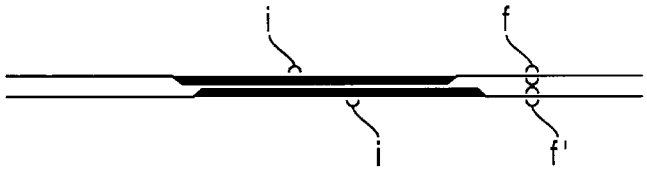

METHOD OF PRINTING ON THE EDGE OF A BOOK

BACKGROUND OF THE INVENTION

1. Field of the Invention

This invention relates to a method of providing visible marks such as patterns, words, logos or indicia onto an edge of a stack of sheets or leaves, particularly when the sheets or leaves are assembled together in the form of books or pamphlets.

2. Description of the Related Art

U.S. Pat. No. 1,866,968 discloses printing a mark on the face of each page to be assembled into a book. Such that when the assembled pages are cut to size the assembled pages produce a character at the cut edges after cutting. However, the patent does not disclose a method of providing patterns or indicia on the edges of assembled leaves or sheets of paper.

A method of providing indicia on the edges of a plurality of assembled sheets is disclosed in U.S. Pat. No. 4,823,150. In the method disclosed therein, the sheets of material (paper) are assembled into books and the indicia printed by means of an ink-jet printer which places printed marks on the assembled cut edges by dividing said edges into a grid, and selecting the locations on the edges for printing the indicia and then identifying the locations according to the grid, and subsequently programming the printing means to print the marks in accordance with the locations identified by the grid.

Such a method has the disadvantage that the indicia on the edges are printed in a separate operation after the books have been assembled.

Yet another method of providing marks of the edge of a pamphlet is shown in U.S. Pat. No. 4,427,290 which is utilized in photocopiers which are specifically modified for the process.

U.S. Pat. No. 4,949,999 describes a method of indexing books by placing printed symbols on the edges of the leaves. The patent further describes a method of placing (printing) the elements composing the symbols on the individual leaves. However, the patent does not disclose a method of decomposing the symbol to be printed onto the edge of a book into elements corresponding to the pagination of the stacked leaves prior to the actual printing process.

U.S. Pat. No. 3,817,492 illustrates a book wherein each leaf is marked on its face edge prior to cutting the leaf to size and whereby the cut passes through the mark on each leaf. The patent does not disclose a method of obtaining these marks by decomposing the symbol to be provided on the edge of the book into its elements prior to placing the marks onto the leaves.

In the present invention the indicia or indicia on the edges are formed during the printing operation for each respective sheet or leaf in the book. This has the advantage that the system is flexible, cheap, and can be utilized on standard printing equipment when controlled by a microprocessor.

SUMMARY OF THE INVENTION

According to the invention, there is provided a method of providing at least one indicia on the edges of a plurality of stacked leaves assembled one on top of the other to form a book or pamphlet, each respective leaf having at least one pigmented mark at at least one predetermined location on at least one face of the leaf at its edge margin adjacent said edge, the assemblage of the marks on the individual faces of the leaves forming said indicia on the edge wherein prior to placing said at least one indicia on the edges of the leaves the indicia are broken down by computer-controlled means into a matrix of pixel elements and each pixel element is assigned Cartesian coordinates according to the X and Y co-ordinate system with Y ordinates corresponding to the pagination of a respective leaf in the stacked leaves, and X coordinates for said respective leaf corresponding to individual mark elements on the face of a leaf that are required along said Y ordinate for forming the indicia.

Preferably each leaf is a paper leaf, and each leaf is marked on its face edge margin prior to cutting the leaf to size, the cut passing through said marks on each leaf.

The computer-controlled means also control the print means for marking the edge margins of the leaves.

The invention also provides a method of printing indicia on the edge of an assembly of sheets which takes into account the variations in the manufacturing process when printing and assembling the sheets to form a book or pamphlet.

Other advantages of the system are that it is easily controlled by any common 386 or 486 microprocessor and it can be used with cheap plain paper.

The invention further provides for books having edges with at least one indicia thereon being formed according to the above methods.

Yet another aspect of the invention provides for an apparatus for placing at least one indicia on the edges of a stack of leaves forming a book or pamphlet, said apparatus including programmable control means which can decompose said indicia into X and Y coordinates with the Y ordinates being related to the pagination of a particular leaf in the stack, and the X ordinates corresponding to the individual mark element or elements on the face of a leaf that are required along that Y ordinate.

Various objects and advantages of this invention will become apparent to those skilled in the art from the following detailed description of the preferred embodiment, when read in light of the accompanying drawings.

BRIEF DESCRIPTION OF THE DRAWINGS

FIG. 9 illustrates the indicia when the marks are of the type shown in the second embodiment shown in FIG. 7 with some misalignment;

FIG. 10 illustrates indicia of the type shown in FIG. 9 on one face of one leaf according to the second embodiment of the invention;

FIG. 11 is an edge view of a leaf according to a third embodiment of the invention;

FIG. 12 is an edge view of a leaf according to a fourth embodiment of the invention;

FIG. 13 is an edge view of a leaf printed on one face according to the second embodiment of the invention.

DETAILED DESCRIPTION OF THE PREFERRED EMBODIMENT

Figure 1:
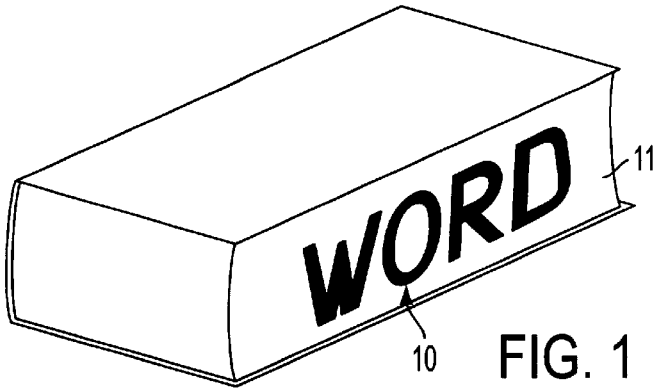
FIG. 1 shows a book comprising an assembly of leaves or sheets having indicia on an edge thereof.

Referring now to the drawings, there is illustrated in FIG. 1 a bound book indicia (10) on the fore edges (11) of the assembled pages of the bound sheets or leaves forming the book. In this case, for the purpose of illustration only, the indicia (10) spell out the word "WORD", but could be any pattern, logo or trade mark as is desired.

Figure 2:
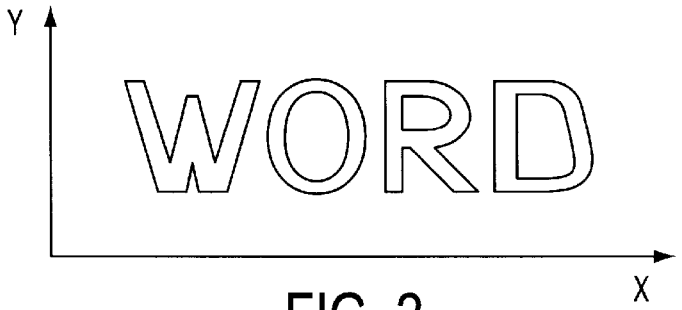
FIG. 2 illustrates the forming of indicia into X and Y coordinates.

With reference to FIG. 2, the indicia are initially decomposed into Cartesian coordinates according to an XY co-ordinate system. This is achieved using a computer program. The image or indicia is converted into data form by scanning, or keyboard input, or by any suitable method. Indicia images are converted into individual information (pixel) elements according to the best method. Preferably, the images are treated by the computer program so that images are sorted into a 'bitmap' type file. Other suitable methods may also be used, but preferably the information files formed using other techniques are transformed into the 'bitmap' form.

The filed images are fed into the program and are inserted into a matrix breaking down the image into two dimensions. The image elements are thus divided into their horizontal and vertical ordinates.

If it is required to print on one side of the leaf or page of a book, then the smallest Y element corresponds with the thickness of the page, and if it is required to print on both sides of the leaf, the smallest Y element corresponds with ½ thickness of each leaf. Thus, the Y ordinates can be made to correspond perfectly with the pagination of the book.

Figure 3:
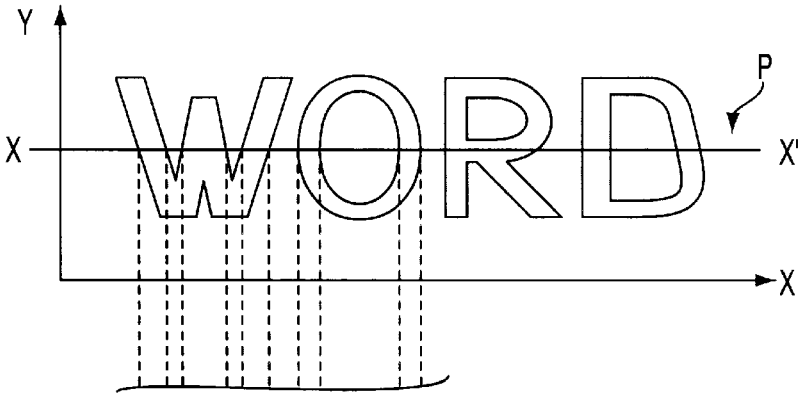
FIG. 3 shows how X coordinates are derived for a particular Y ordinate corresponding to a particular leaf in the assembly.

With respect to FIG. 3, taking a particular Y ordinate corresponding with leaf P, then the X coordinates for the particular Y ordinate build up a data line so that all elements (21–28) of the indicia are included in the line X-X'.

Figure 4:
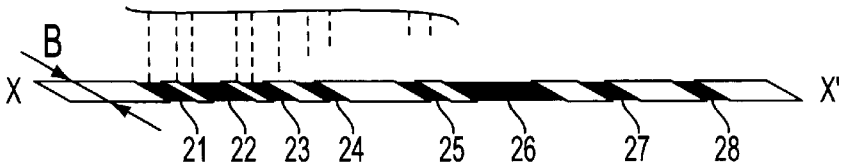
FIG. 4 shows the edge margin of the leaf in FIG. 3 with marks formed thereon according to first embodiment of the invention.

The division of the image in the 'X' dimension can be defined so that the smallest element of the image is given an arbitrary constant value, this may be typically 0.05 mm. The "pixel" obtained is calibrated so its dimensions are proportional to the physical dimensions of the elements to be printed. This information may be transferred to an imaginary line as shown in FIG. 4 and thickened to a width B to make the elements visible.

Figure 5:
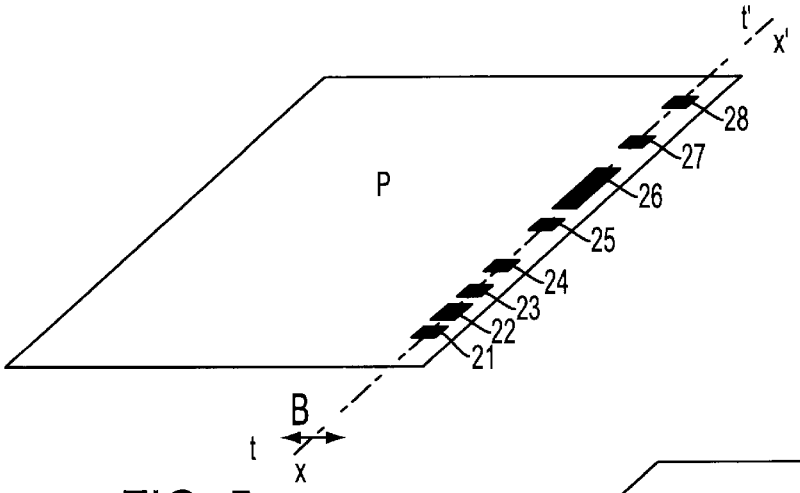
FIG. 5 and FIG. 6 show how the marks of FIG. 4 may be located at the edge.
Figure 6:
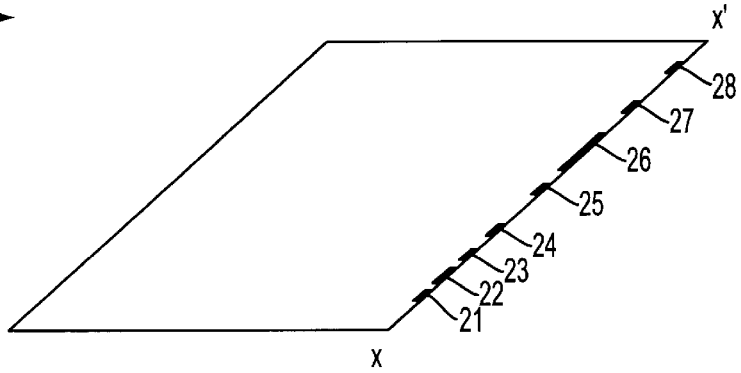

These elements (21–28) are then used to print marks on the edge margin of at least one face of a respective leaf on page P (see FIG. 5) in the course of the printing process, i.e. while the respective leaf is being printed such that the width B of the elements straddles the cut line or trim line (t-t') of the leaf. The cutting or trimming takes place after the book has been assembled, and passes through the X-X' element marks on each leaf. The leaf P after trimming is shown in FIG. 6.

Alternatively, the X-X' element marks (21–28) for leaf P may be printed on the edge of the leaf so that the element marks (21–28) intersect with the face edge of each leaf.

This operation is repeated for every leaf in the book so that, on assembly of the book, the marks on each edge form the indicia (10) on the fore edge (11) of the book.

The same technique can be additionally or alternatively applied to the top edge and bottom edge of the book and hence the book can be provided with indicia on its three (unbound) edges in the course of the normal printing operation.

A controller such as a microprocessor uses the computer program for decomposing the indicia into their X-X' elements with respect to the pagination of the assembly, and for determining the order of the elements for each leaf and the distribution relative to the edge margin of each leaf.

The program calculates the precise position of every point, taking into account various parameters, such as the variations in the lengths and widths of the leaves and the thickness of the leaves, to give a precise distribution of the elements of the indicia along the cutting axis t-t'.

The elements composing the indicia are then printed to form marks on a print face of each leaf along its respective edge margins. The print operation may be controlled by said controller using the X-Y coordinates derived above. When the assembled pages are bound, the marks on the faces of each leaf form indicia on the fore edge of the book.

According to the requirements of the user, the component program may process the pixels in order to obtain their assigned shadings to ameliorate alignment faults due to production tolerances.

Figure 7:
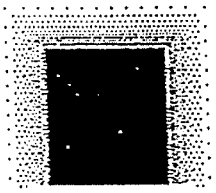
FIG. 7 illustrates a mark with color fading at the edges according to a second embodiment of the invention.

According to a second embodiment of the invention, the elements (21–28) composing the indicia are preferably printed so that the marks have a high pigment density at their centers and fade towards at least some of their edges, as shown in FIG. 7. The rate of pigment fade can be chosen to suit manufacturing tolerances in the overall process. These tolerances may build up in the actual printing process, the properties of the paper, the assembly process and trimming process. The tighter the tolerances, the less the required fall-off in pigmentation.

Figure 8:
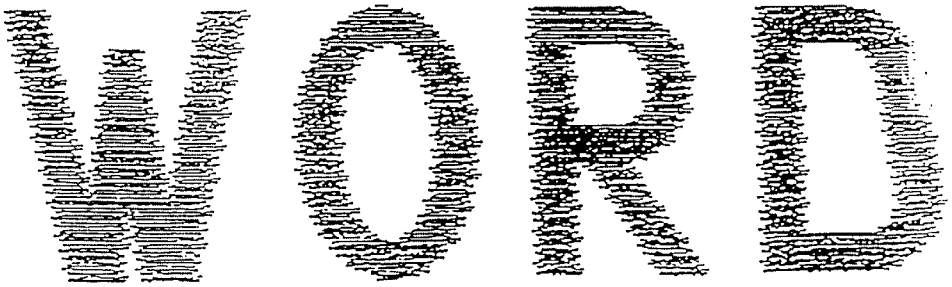
FIG. 8 illustrates the indicia when the marks according to the first embodiment on the different pages are misaligned.

In the case of a book as shown in FIG. 1, if there are large variations in alignments of the marks on the edges of the leaves, the indicia become fuzzy, as shown in FIG. 8.

However, the degree of fuzziness can be controlled by using marks with deliberate degrees of pigmentation fade to mask the production variations. This will be discussed in detail below. By using elements of the type shown in Fig, 7 for every group of elements assigned to particular X-X' lines on the particular faces of leaves (see FIG. 10), it is possible to produce a desired and controlled fuzziness, as shown in FIG. 9.

Another means of masking the variations in leaf or sheet alignment is illustrated by the third embodiment of the invention shown in FIG. 11. The marks corresponding to particular elements of the indicia are put in different widths (see FIG. 11) on the front face (f) and back face (f') of each leaf.

According to a fourth embodiment of the invention, as shown in FIG. 12, the marks are offset along the X-X' axis on the front face (f) and back face (f') of each leaf.

The density of pigmentation in the marks varies for a given point on the edge of the sheet when observed through the edges of the assembled sheets as a result of the amount of ink (i) on the sheet edges.

The consecutive elements composing the indicia and having different widths or being offset can be printed on the front and back face of each sheet (f, f') as shown in the third and fourth embodiments illustrated in FIGS. 11 and 12 or on one face only of consecutive sheets. Further, it is possible to apply the marks to all sheets or only some sheets.

Throughout this specification, the word 'printing' is meant to cover all techniques of providing a visible mark onto a support and the word 'ink' is meant to cover all pigmented marks making up the visible mark.

By printing on both faces of the leaves of the book or pamphlet it is possible, through the use of different density shading and/or different colors, to print on the odd-numbered pages different messages or logos to those on the even-numbered pages and to give an impression which interacts with the reader who manipulates the pages. For example, a first message such as the name or logo of a firm could be printed on the fore edge of the odd-numbered pages and a second message, such as a telephone number, could be printed on the fore edge of the even-numbered pages. When the fore edge of the book or pamphlet is flexed in the right direction, the first message becomes visible in a denser form than the second message since a larger part of the edge portion of the odd-numbered pages becomes visible. Conversely, when the fore edge of the book or pamphlet is flexed in the left direction, the second message becomes visible in a denser form than the first message.

By making a first message in heavier print or in a different color than the second message, it is possible to provide two superposed messages, the first message dominating the second message.

According to the wishes of the user, the program processes the pixels in order to obtain the necessary shadings to ameliorate the faults in adjustment as discussed earlier.

The preferred method for achieving these shadings is by algorithmic calculations. The fringe pixels, i.e. the pixels forming the fringes (edge portions) of the element to be processed are corrected on the one hand according to variable parameters, and on the other hand according to calculation. Each fringe pixel is corrected by applying to it a grading (shading) in relation to its neighboring pixels. Hence, each fringe pixel is corrected by horizontal scanning, then vertical scanning, and lastly by scanning across each of its diagonals, that is four scans in order to determine the level of shading desired. In general, this process is done at a speed determined by the capacity of the processor and takes only fractions of a second.

Figure 14A:
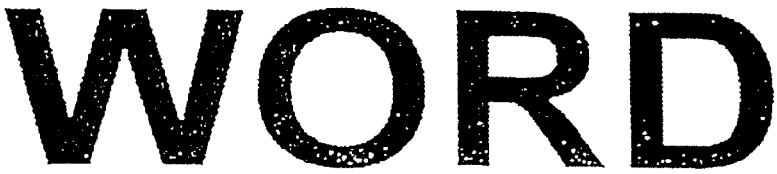
FIG. 14*a* shows typical indicia which can be provided on the edges of a stack of sheets and FIGS. 14*b–d* show the same indicia which are altered by altering the shading in the outer elements making up the edges of the indicia.
Figure 14B:
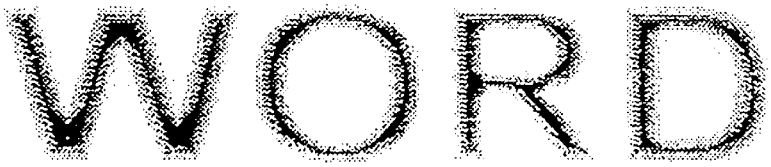
Figure 14C:
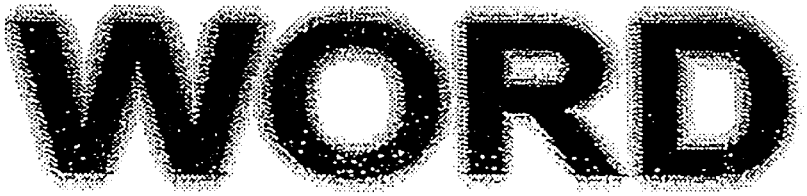
Figure 14D:
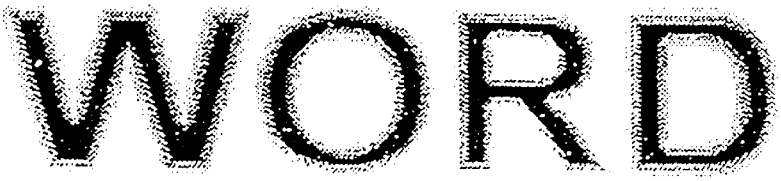

For example, for a black motif on a white background as shown in FIG. 14*a*, the user can select a grading to make the edge pixels of a lighter shade towards the interior as shown in FIG. 14*b* (in-shading). Alternatively, the user can make the edge pixels of a darker shade fading outwardly to add shaded matter as shown in FIG. 14*c* (outshading), or better still, shade the edges in both directions, see FIG. 14*d*.

In other words, the in-shading of the edge pixels can be used to reduce the visible surface (or a proportion thereof) and the out-shading of the edge pixels can be used to increase the visible surface, and in combination give an accurate reproduction of the original.

As previously described, the matrix of each motif or indicia is divided into horizontal strata such that each stratum (line X, FIG. 4) for a particular page contains a sequence of data to be sent.

The user of the program may also define the width of the indicia that theoretically appears on the page and the width of the indicia that is removed with the trimmings (see FIG. 6). The width for each stratum is then defined so as to obtain a sequence or bundle of elements of width B (see FIG. 5). In this manner, as previously described, during the final stages of binding, the book trim line will pass through the ink zone and not to one side.

For any element, each sequence or bundle of data is sent to its proper place for each page including any text, with the exception that any data sequence relating to the edge motif is positioned in the margin of the page. This allows for high accuracy as the elements of the motif are positioned and printed with the text. All imposition corrections to the print can be applied automatically without error.

When it is required to print on more than one outer edge of the book, care must be taken that the data composing the indicia are sequenced in the right order. For example, if a book is to be provided with messages on its three unbound edges, and if these messages are to be readable when the book is placed in horizontal position on its back cover, the data composing the indicia on the bottom edge of the odd-numbered pages and the data composing the indicia on the top edge of the even-numbered pages must be sequenced in the reading direction, i.e. from left to right. However, the data composing the indicia on the top edge of the odd-numbered pages and the data composing the indicia on the bottom edge of the even-numbered pages must be sequenced in the direction opposite to the reading direction, i.e. from right to left.

The computer program operates simultaneously in all three matrices (top, bottom and fore edge) and for each page or stratum gives three streams of data which relate to the exact positions of the elements of the motifs along each edge of the page, the sequential order of each stream of data being determined as explained above.

In the program each color is produced independently by layers or similar techniques as is required.

Each bundle of data for each stratum may be sent as needed by color, by page, particularly or all at once towards different points such as screens, discs, printers, modems, or to a software editor or simply be integrated with other data and final transfer to a printer.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

I claim:

1. A method of printing at least one indicia on at least one edge of a plurality of leaves assembled one on top of the other to form a book or pamphlet, the at least one indicia being formed by an assemblage of pigmented marks on the assembled plurality of leaves, the method comprising the steps of:

(a) decomposing the at least one indicia to be printed by computer into a matrix of pixel elements;

(b) assigning by computer x-y coordinates to pixel elements such that each y-coordinate is assigned to correspond perfectly to the pagination of each leaf of the plurality of leaves, and each x-coordinate is assigned to correspond to a pigmented mark of the assemblage of pigmented marks; and (c) prior to assembling the plurality of leaves to form a book or pamphlet, printing the assemblage of pigmented marks on the at least one edge of the plurality of leaves at the assigned x-y coordinates.

2. A method according to claim 1, further comprising the step of cutting each leaf to size subsequent to said printing step, the cut passing through the assemblage of pigmented marks forming said at least one indicia.

3. A method according to claim 1, further comprising the step of transferring the x-coordinates for each leaf to an imaginary line having a predetermined thickness.

4. A method according to claim 1, wherein the at least one pigmented mark is printed with a pigmented central area fading toward at least one edge thereof.

5. A method according to claim 1, wherein the assemblage of pigmented marks have a minimum width at the edge and a predetermined location such that the aligned marks form the at least one indicia, and misalignment in said marks are compensated for by adjacent marks having different widths, even when nominal widths of adjacent marks are the same when the plurality of leaves are assembled.

6. A method according to claim 1, wherein the assemblage of pigmented marks are printed to have a nominal width at the at least one edge and a predetermined location, such that the aligned marks form the at least one indicia and the marks on alternate leaves are off-set from those on adjacent leaves when the plurality of leaves are assembled.

7. A method according to claim 1, wherein said assemblage of pigmented marks are printed on a plurality of leaves formed from a cellulose-based material.

8. A method according to claim 1, wherein the at least one pigmented mark is printed on only one face of each leaf of the plurality of leaves.

9. A method according to claim 8, wherein a separate y-coordinates is assigned to each leaf of the plurality of leaves.

10. A method according to claim 1, wherein the at least one pigmented mark is printed on both faces of each leaf of the plurality of leaves.

11. A method according to claim 10, wherein a separate y-coordinates is assigned to each side of the plurality of leaves.

12. A method according to claim 1, wherein an assemblage of pigmented marks for a plurality of indicia are printed on the at least one edge of the plurality of leaves.

13. A method according to claim 1, wherein the x-coordinates are assigned to correspond to a width of the at least one pigmented mark.

14. A method according to claim 1, wherein each leaf is printed on both faces adjacent one edge of the plurality of leaves, and wherein the marks are printed on one face differing in at least one of density of shading, color, and form from the marks on the other face so that when flexing the leaves in opposite directions different indicia are seen on the edge of the book or pamphlet.

15. A method according to claim 1, and further comprising the steps of stacking the plurality of leaves in the sequence of the y-coordinates, and of binding the plurality of leaves subsequent to said stacking step.

16. A method of printing at least one indicia on at least one edge of a plurality of leaves assembled one on top of the other to form a book or pamphlet, the at least one indicia being formed by an assemblage of pigmented marks on the assembled plurality of leaves, the method comprising the steps of:

(a) converting the at least one indicia to be printed by computer into a matrix of pixel elements;

(b) deriving by computer a set of x-y coordinates corresponding to the matrix of pixel elements such that each y-coordinate is derived to correspond perfectly to the pagination of each leaf of the plurality of leaves, and each x-coordinate is derived to correspond to a pigmented mark of the assemblage of pigmented marks; and (c) prior to assembling the plurality of leaves to form a book or pamphlet, printing the assemblage of pigmented marks on the leafs at the x-y coordinates in the derived set forming the at least one indicia on the at least one edge of the plurality of leaves.

17. A method according to claim 16, further comprising the step of calibrating each pixel of the matrix of pixel elements to have a dimension proportional to a dimension of the pigmented mark to be printed at such pixel.

18. A method according to claim 17, further comprising the step of transferring the calibrated pixel elements for each leaf to an imaginary line having a predetermined width.

19. A method according to claim 16, and further comprising the steps of stacking the leaves with the printed marks in the sequence of the y-coordinates, and of binding the plurality of leaves subsequent to said stacking step.

20. A method for printing at least one indicia on at least one edge of a plurality of leaves which are then assembled one on top of the other to form at least a portion of a book or pamphlet, said method comprising the steps of:

determining the number of leaves in said plurality of leaves and the thickness of each of said plurality of leaves;

using a programmed computer to convert the at least one indicia to be printed into a matrix of pixel elements;

using a programmed computer to convert the indicia into a set of x-y coordinates such that each y-coordinate corresponds perfectly to the determined thickness of a leaf and, for each y-coordinate, each x-coordinate corresponds to a pixel element located at such y-coordinate;

assigning a y-coordinate to at least one side of each leaf;

printing on at least one side of each leaf adjacent the at least one edge the pixel elements at each x-coordinate for the y-coordinate assigned to such leaf; and assembling the printed leaves to form a book or pamphlet having the indicia on the at least one edge.

21. A method according to claim 20, and including the step of assigning each pixel a shading which is printed to either side of the x-coordinate for such pixel to compensate for tolerance variations when the leaves are assembled to form a book or pamphlet.

22. A method for printing at least one indicia on an edge of a plurality of leaves which are then assembled one on top of the other to form a book or pamphlet, said method comprising the steps of:

(a) using a programmed computer to convert the indicia to be printed into first and second matrixes of pixel elements;

(b) using a programmed computer to convert the first matrix into a first set of x-y coordinates such that each y-coordinate in said first set corresponds perfectly to one side of a leaf and, for each y-coordinate in said first set, such that each x-coordinate in said first set corresponds to a pixel element in said first matrix located at such y-coordinate;

(c) using a programmed computer to convert the second matrix into a second set of x-y coordinates such that each y-coordinate in said second set corresponds perfectly to an opposite side of a leaf and, for each y-coordinate in said second set, such that each x-coordinate in said second set corresponds to a pixel element in said second matrix located at such y-coordinate;

(d) assigning a y-coordinate in said first set to the one side of each leaf and a y-coordinate in said second set to the other side of each leaf;

(e) printing on the one side of each leaf adjacent the edge the pixel elements at each x-coordinate for the y-coordinate in said first set of x-y coordinates assigned to the one side of such leaf, and printing on the other side of each leaf adjacent the one edge the pixel elements at each x-coordinate for the y-coordinate in the second set of x-y coordinates assigned to the other side of such leaf; and (f) assembling the printed leaves to form a book or pamphlet having the indicia on the at least one edge.

23. The method of claim 22, and including the step of assigning each pixel a shading which is printed to either side of the x-coordinate for such pixel to compensate for tolerance variations when the leaves are assembled to form a book or pamphlet.

24. The method of claim 22, and wherein the x-coordinates for the one side of each leaf correspond substantially to x-coordinates for the other side of such leaf, and wherein, for at least some of the leaves, corresponding pixels on the first and second sides of the leaf are printed to differ in at least one of density of shading, color and form.

25. The method of claim 22, and wherein first and second indicia are printed on an edge of a plurality of leaves, wherein a programmed computer converts said first indicia into said first matrix of pixel elements and converts said second indicia into said second matrix of pixel elements.

* * * * *